United States Patent [19]

Koski

[11] Patent Number: 4,514,259

[45] Date of Patent: Apr. 30, 1985

[54] HEADBOX FOR A PAPER MACHINE

[75] Inventor: Erkki Koski, Jyväskylä, Finland

[73] Assignee: Valmet Oy, Finland

[21] Appl. No.: 432,370

[22] Filed: Sep. 30, 1982

[30] Foreign Application Priority Data

Oct. 12, 1981 [FI] Finland ..... 81958

[51] Int. Cl.[3] ..... D21F 1/06

[52] U.S. Cl. ..... 162/343; 162/336; 162/340

[58] Field of Search ..... 162/336, 339, 340, 343

[56] References Cited

U.S. PATENT DOCUMENTS 3,563,852 2/1971 Rojecki ..... 162/343
3,802,966 4/1974 Delekto et al. ..... 162/343
4,137,124 1/1979 Bubik et al. ..... 162/343

FOREIGN PATENT DOCUMENTS 2039293 3/1972 Fed. Rep. of Germany ..... 162/343

*Primary Examiner*—Peter Chin
*Attorney, Agent, or Firm*—Steinberg & Raskin

[57] ABSTRACT

A headbox for a paper machine includes a distributor beam part communicating with a distribution part and a turbulence part followed by a slice part. The turbulence part is constituted by a turbulence generator member in which a plurality of flow bores are formed, the outlet mouths of the flow bores opening into flow slots formed in the turbulence generator and wherein a central plane of each flow slot forms an angle with the axes of the flow bores, the magnitude of the angle being in the range of about 5° to 45°. The headbox may also include an equalizing chamber in which a pulp suspension is adapted to flow in an upwardly slanted flow direction and in this case the axes of the flow bores form a declining angle with the flow direction in the equalizing chamber, which declining angle is in the range of about 5° to 15°.

24 Claims, 8 Drawing Figures

HEADBOX FOR A PAPER MACHINE

BACKGROUND OF THE INVENTION

The present invention relates generally to headboxes for paper machines and, more particularly, to a headbox which comprises a distributor beam part, a distribution part connected to the distributor beam part, and a turbulence part which is followed by a slice part, such as a slice-cone part or the like.

With respect to the prior art technology related to the present invention, reference is made to applicant's Finnish Pat. No. 50,260. A headbox is disclosed in this Finnish patent in which the distributor beam is followed by a distributor-pipe part after which a so-called intermediate-chamber part is provided followed by a lamella part, which in turn is followed by the slice-cone part. The lamella part is constituted by several lamellae which are placed in side-by-side relation and which are inclined with respect to the vertical plane. The lamellae define turbulence channels between them having a trapezoidal cross-sectional configuration.

Although the headbox disclosed in the above-mentioned Finnish patent has proven to be quite advantageous in operation, it has been found to be quite expensive in construction, at least in part due to the intricate construction of the lamella part. Another drawback of this prior art apparatus is that the headbox occupies a relatively large space since the lamella part has a relatively long length. Moreover, replacement of the lamella part to provide one best suited for the particular paper or pulp quality which is being produced is inconvenient.

Since the present invention is also suited for use in multi-layer headboxes, reference is also made by way of example to Finnish patent application Ser. No. 801,587, assigned to applicant's assignee, which discloses a multilayer headbox for a paper machine which comprises two or more pulp suspension flow channels situated one over the other so as to merge within the region of the headbox slice. The flow channels comprise a distributor beam part, a distributor-pipe part or the like as well as flow-equalizing and turbulence parts. The headbox disclosed in this Finnish application is characterized in that between the flow-equalizing part and the turbulence part, there is a heavy plate part which is provided with a set of flow openings and the turbulence part is constituted by several plate lamellae situated in side-by-side relationship and fixed in connection with the plate part substantially only at their forward ends. One or more intermediate plates are located between the sets of plate lamellae and extend to the region of the slice of the headbox.

It is a particular object of the present invention to provide a new and improved headbox in which the lower-lip constructions by means of a unified lower-part frame and in which the above-described lamella part construction is replaced by a construction which is considerably less expensive and which can be readily exchanged in accordance with the requirements imposed by the particular production being run.

With respect to the prior art relating to the present invention, further reference is made to Finnish patent applications No. 801,854 filed June 10, 1980, and Ser. Nos. 802,695 and 802,696 filed Aug. 26, 1980, all of which are assigned to applicant's assignee. It is another object of the present invention to provide a new and improved headbox in which the improvements disclosed in these Finnish patent applications are applicable, where appropriate.

In particular, with reference to Finnish application No. 801,854, a headbox is disclosed having a cassette-type construction, i.e., wherein the turbulence part is constituted by one or more exchangeable grate cassette members. More particularly, this application discloses a grate-shaped turbulence generator situated between the equalizing chamber and the slice cone. However, this construction is not entirely satisfactory in that the flow of the pulp suspension does not change its direction within the zone of the grate member. In this connection, it is generally desirable to change the direction of flow in that, generally, within the initial portion of the headbox, the construction is such that the flow is first directed to slant upwardly whereas the flow is usually discharged in a substantially horizontal direction from the slice cone. Therefore, in accordance with the prior art, the flow direction of the pulp suspension is generally changed within the region of the slice cone. However, since the pulp suspension flow is discharged from the slice cone onto the wire, a change in flow direction which takes place within the area of the slice cone may result in an instability in the flow with resulting flaws being created in the web produced.

Accordingly, it is another object of the present invention to provide a new and improved headbox in which a change in the flow direction of the pulp suspension takes place before the region of the slice cone and wherein the change in direction additionally results in favorable effects, described in greater detail below.

It is also known in the prior art to provide arrangements in a headbox of a paper machine in which step structures are present in the path of the flow of the pulp suspension which increase the turbulence thereof, as well as structures which cause the flow from tubes to be spread into slot-shaped spaces which extend transversely across the headbox. In this connection, reference is made by way of example to U.S. Pat. Nos. 3,528,882, 3,562,107, 3,954,558, 4,070,238, and 4,137,124. Moreover, reference is made to Swedish Pat. No. 214,100, U.K. patent application No. 2,019,465 and to Finnish patent application No. 447/71. However, none of these prior art solutions teaches or suggests the use of the change in direction of the pulp suspension flow as a means to control the flow or to render it advantageous by spreading the flow.

SUMMARY OF THE INVENTION

Briefly, in order to achieve the objectives enumerated above, as well as others, the headbox of the present invention is characterized in that the turbulence part of the headbox is constituted by a turbulence generator member which is provided with a plurality of flow bores, the outlet mouths of the flow bores open into flow slots formed in the turbulence generator member, the direction of a central plane of each flow slot forming a small angle with respect to the axial directions of the flow bores, and the magnitude of the angle is in the range of about 5° to 45°.

The turbulence generator member in accordance with the present invention can be used in headboxes wherein an equalizing part or the like is situated in the flow path of the pulp suspension after the distributor-pipe part, the equalizing part being in direct communication with an air tank, and after which equalizing part a turbulence part is provided which itself is followed by the slice cone part.

The present invention may also be applied to headboxes having a shorter length wherein the turbulence generator member in accordance with the invention at the same time functions as the distributor-pipe part. In such a headbox, one wall of the distributor beam will be constituted by the turbulence generator member in which a plurality of flow bores are formed, the inlet mouths thereof opening into the distributor-beam part and the other side of the turbulence generator member facing the slice cone part.

DESCRIPTION OF THE DRAWINGS

A more complete appreciation of the present invention and many of the attendant advantages thereof will be readily understood by reference to the following detailed description when considered in connection with the accompanying drawings in which.

DESCRIPTION OF THE PREFERRED EMBODIMENTS

Figure 1:
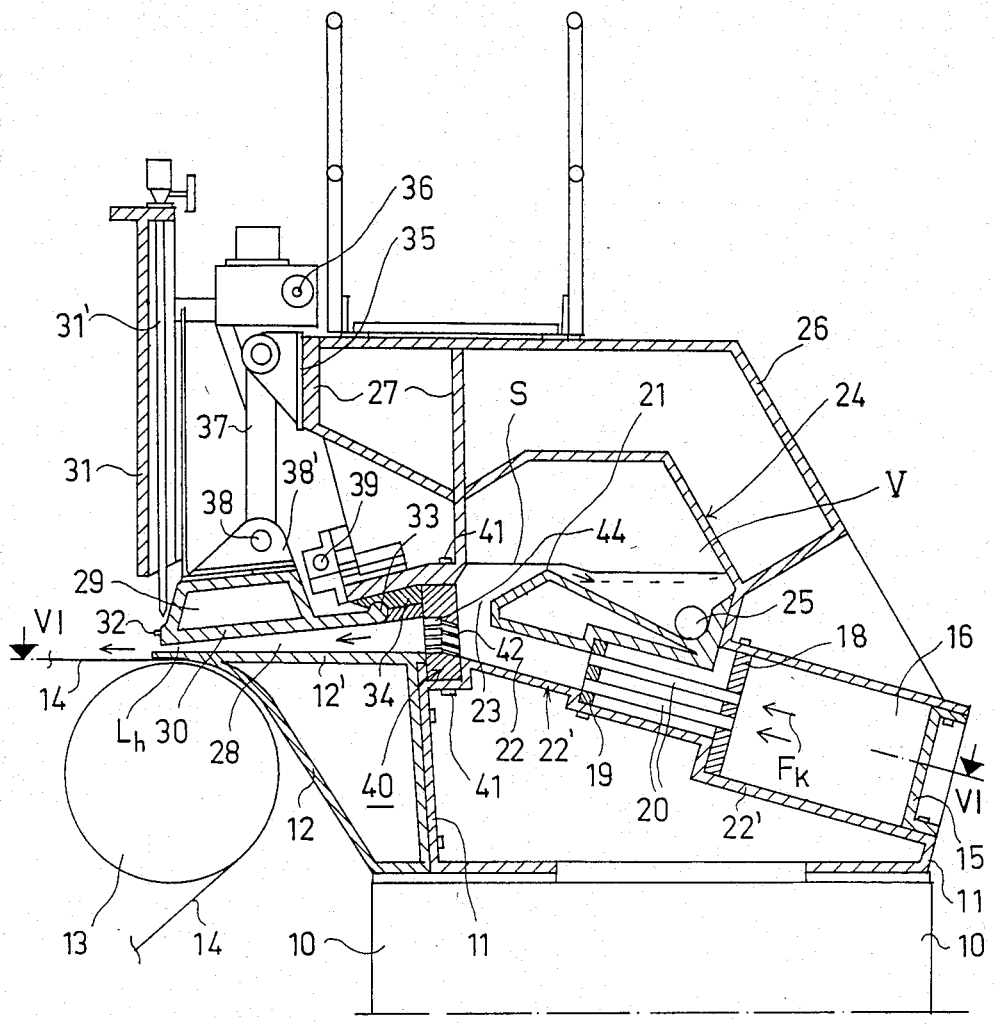
FIG. 1 is a side section view of a headbox in accordance with the present invention.
Figure 8:
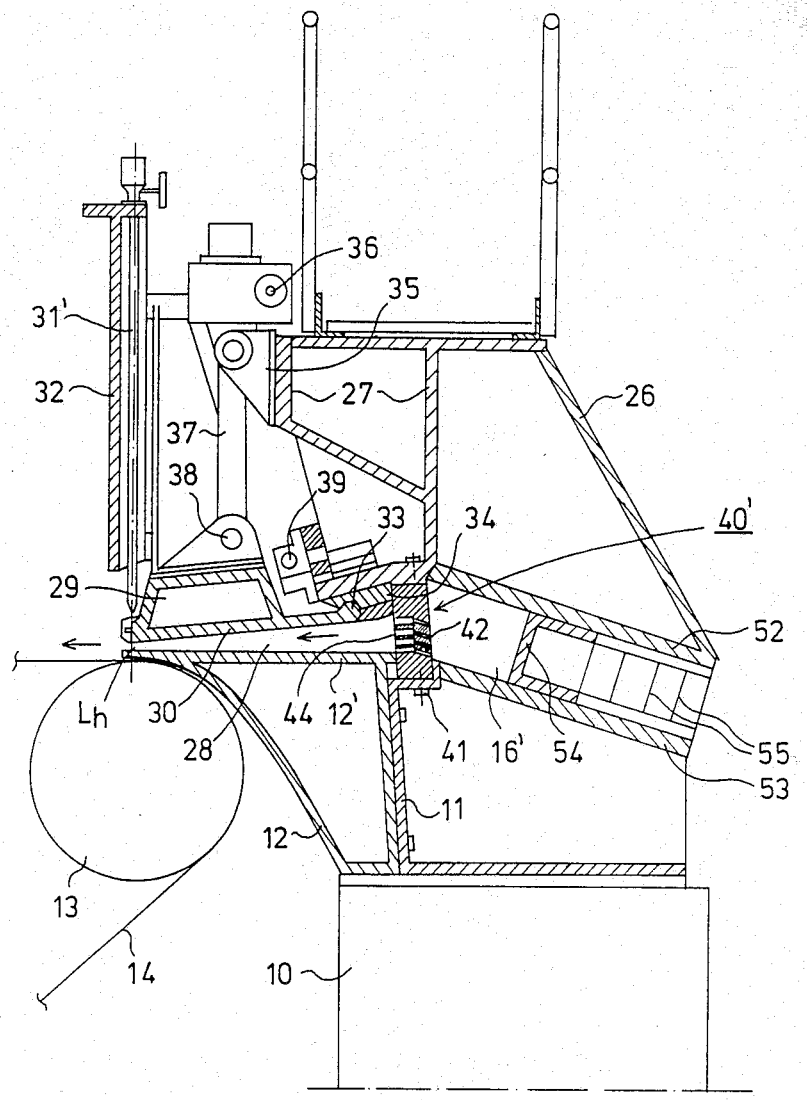
FIG. 8 is a view similar to FIG. 1 illustrating another embodiment of a headbox in accordance with the present invention, the headbox of FIG. 8 having neither an equalizing part nor an air container communicating therewith.

Both the headboxes illustrated in FIGS. 1 and 8 respectively are supported on base or pedestal structures 10. Each headbox comprises a lower beam 11 which includes an upper wall 22' in the case of the FIG. 1 embodiment and an upper wall 53 in the case of the FIG. 8 embodiment. The pulp suspension jet is discharged onto the wire 14 passing over a breast roll 13 through the slice $L_h$ of the headbox.

In accordance with the embodiment of FIG. 1, the pulp suspension is introduced into the headbox by means of a distributor beam 15, a flow channel 16 situated therewithin extending transversely with respect to the direction of flow which takes place in the other parts of the headbox. After the distributor beam 15, the headbox includes a distributor pipe system 20 between plate parts 18 and 19. After the plate part 19, an equalizing chamber part 22 is provided which is directly connected to an air container 24 by way of a channel 23 having a width which is substantially equal to the width of the headbox. An air cushion, designated V, is formed within the air container 24 by means of which pressure disturbances in the pulp suspension flow are attenuated in a conventional manner. A dam 21 is formed within the channel 23 which controls the level of the surface S of the pulp suspension in connection with the air cushion V. An overflow pipe 25 is situated beneath the dam 21.

In accordance with the FIG. 1 embodiment, the upper wall of the air container 24 at the same time constitutes the lower wall of a beam 26 which functions as a structural component of the headbox. A projection part 27 constituted by an extension of the beam 26 has a front wall to which the shifting equipment of an upper-lip beam 29 is fastened by means of a joint 35, the shifting equipment including a worm gear 36 and a vertical member 37. A bracket 38' is fastened to the vertical member 37 by means of an articulated shaft 38, the upper-lip beam 29 being fastened to the bracket 38'. The rear part of the upper-lip wall 30 of the upper-lip beam 29 is attached by means of a link arrangement 33 to a guide 34 which can be shifted by means of a worm gear 39 so as to move the upper-lip wall 30 in the direction of its plane. A front-wall beam 31 of conventional construction is attached to the upper-lip part, the beam 31 being provided with a number of vertical spindles 31' by means of which the lip plate 32 is adjusted in a conventional manner for providing a fine control of the slice $L_h$.

In accordance with the present invention a turbulence generator member 40 is provided, for example in lieu of the lamella part disclosed in Finnish Pat. No. 50,260, mentioned hereinabove. The turbulence generator member 40 comprises a block or plate, preferably formed of metallic material, in which a plurality of appropriately shaped flow passages 42, 44 are formed in side-by-side and/or vertically overlying relationship. The flow passages 42, 44 at the same time also function as described in greater detail below as means for changing the direction of the pulp suspension flow as well as means for spreading the flow from a tubular flow to a slot-type flow.

The turbulence generator member 40 in accordance with the present invention is a cassette-type plate member which can be interchanged when necessary with other turbulence generator members having similar outer configurations. The turbulence generator member is secured in position, for example, by means of screws 41 within grooves 50 (FIG. 2) formed in the frame of the headbox. Thus, although it is within the scope of the invention to provide the turbulence generator 40 with a stationary construction, i.e., as part of the headbox itself, it is often advantageous to arrange the turbulence generator member 40 as an exchangeable member. For example, the construction may be such that the turbulence generator member 40 can be withdrawn after detaching the screws 41 from the side of the headbox whereupon a new turbulence generator member 40 can be inserted into position. In this manner, a fine adjustment of the generation of turbulence can be provided by inserting the appropriate turbulence generator 40 so as to accommodate for example, the particular running speed of the paper machine, the quality of pulp used, or the quality of paper to be produced.

In accordance with the present invention, the turbulence generator member 40, in addition to generating turbulence in the pulp suspension flow, also turns or changes the direction of the flow of the pulp suspension from the upwardly slanting direction to the substantial direction of the slice cone which in the illustrated preferred embodiment is a substantially horizontal direction. However, it is understood that the slice cone can direct the pulp suspension flow in directions other than the horizontal direction and the turbulence generator member is adapted to change the direction of flow of the pulp suspension from its upwardly slanting flow to the direction in which the pulp is discharged from the slice cone. Normally, this turning angle is about 10° to 30°.

Additionally, in accordance with the present invention, at the same time as the direction of the flow of the pulp suspension is changed as discussed above, the tubular flow thereof is changed to a slot-type flow.

Referring now to FIGS. 2–5, the turbulence generator member 40 is constituted by a plate in which several rows of flow bores 42, preferably having circular cross-sections, are formed in the portion of the turbulence generator member 40 proximate to the side of the equalizing chamber 22, the flow bores 42 extending substantially halfway through the length L of the turbulence generator member 40 to its mid-portion. Thus, each of the flow bores 42 has an inlet mouth opening on a front side of the turbulence generator member 40 which faces the equalizing chamber 22 and an outlet mouth situated substantially at the mid-portion of the turbulence generator member 40.

The outlet mouths of the flow bores 42 open into flow slots 44 which are relatively wide with respect to their height, preferably having widths substantially equal to the width of the entire machine. The flow slots 44 are defined between plate-like walls 46, the thicknesses of which are desirably as small as is permitted by the structural circumstances. According to the embodiment illustrated in FIGS. 2–5, the turbulence generator member 40 has five rows of flow bores 42 whose outlet mouths open into a corresponding number of flow slots 44.

Figure 3:
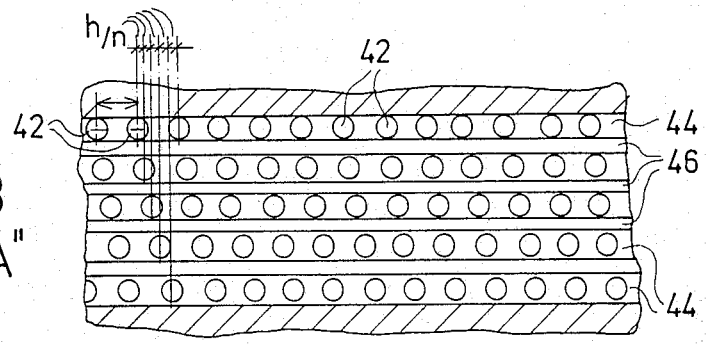
FIG. 3 is a front view of the turbulence part illustrated in FIG. 2 is the direction "A" of FIG. 2.
Figure 4:
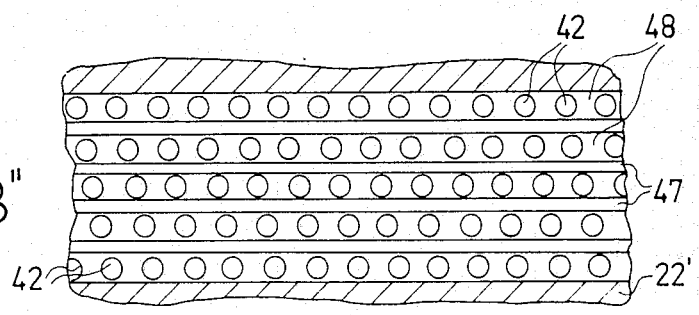
FIG. 4 is a rear view of a turbulence part of a headbox in accordance with the present invention in the direction "B" of FIG. 2.
Figure 6:
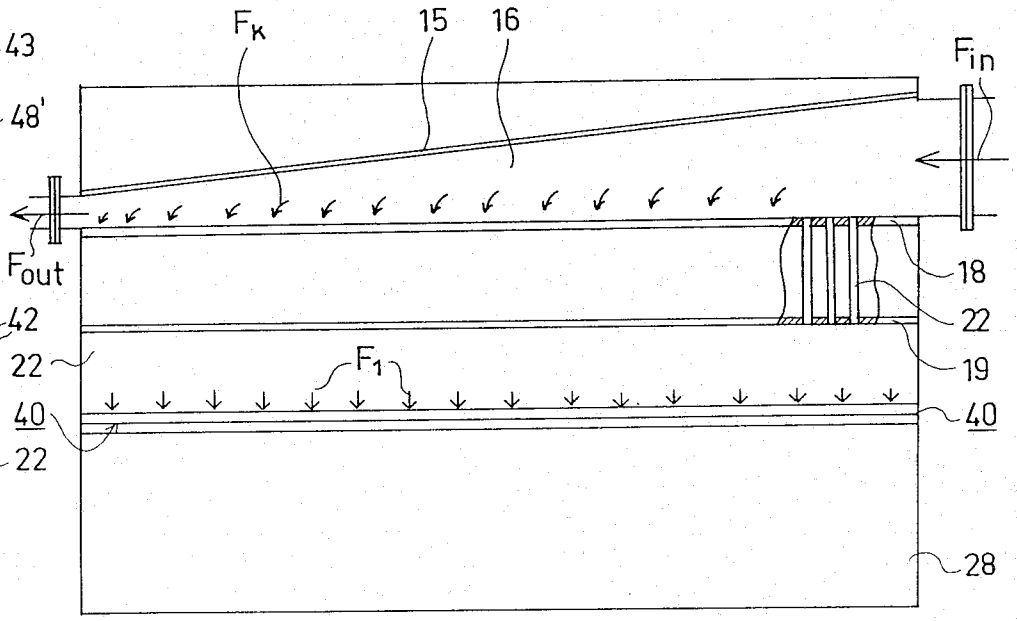
FIG. 6 is a section view taken along line VI—VI of FIG. 1.
Figure 5:
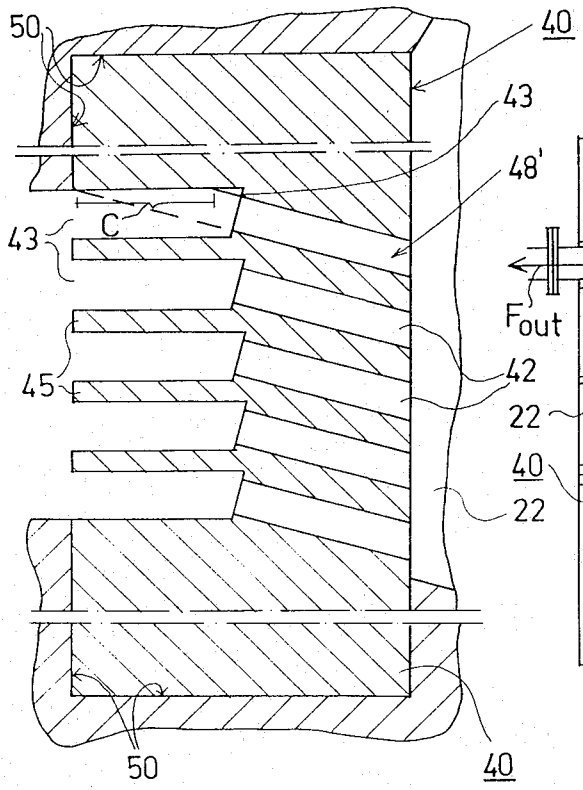
FIG. 5 is a view similar to FIG. 2 illustrating another embodiment of a turbulence part of a headbox in accordance with the present invention.

Referring particularly to FIGS. 3 and 4, the flow bores 42 are arranged in a step-wise fashion so that the distance between the central axes of adjoining bores in the same horizontal row is designated h and so that the flow bores situated in vertically adjacent rows are horizontally shifted with respect to each other by a distance h/n, wherein n is the number of rows of flow bores in the turbulence generator member. In this manner, the flow bores 42 are arranged so as to be aligned along respective lines which are inclined from the vertical plane and in a manner such that the horizontal distance between the axes of the lowest and highest flow bores aligned along such an inclined line is likewise h/n. In this manner it is possible to prevent the possibility that the rows of flow bores might cause streaks in the web being prepared in accordance with the same principal as suggested in the above-mentioned Finnish Pat. No. 50,260 wherein lamellae are used which are inclined in a corresponding manner.

Figure 2:
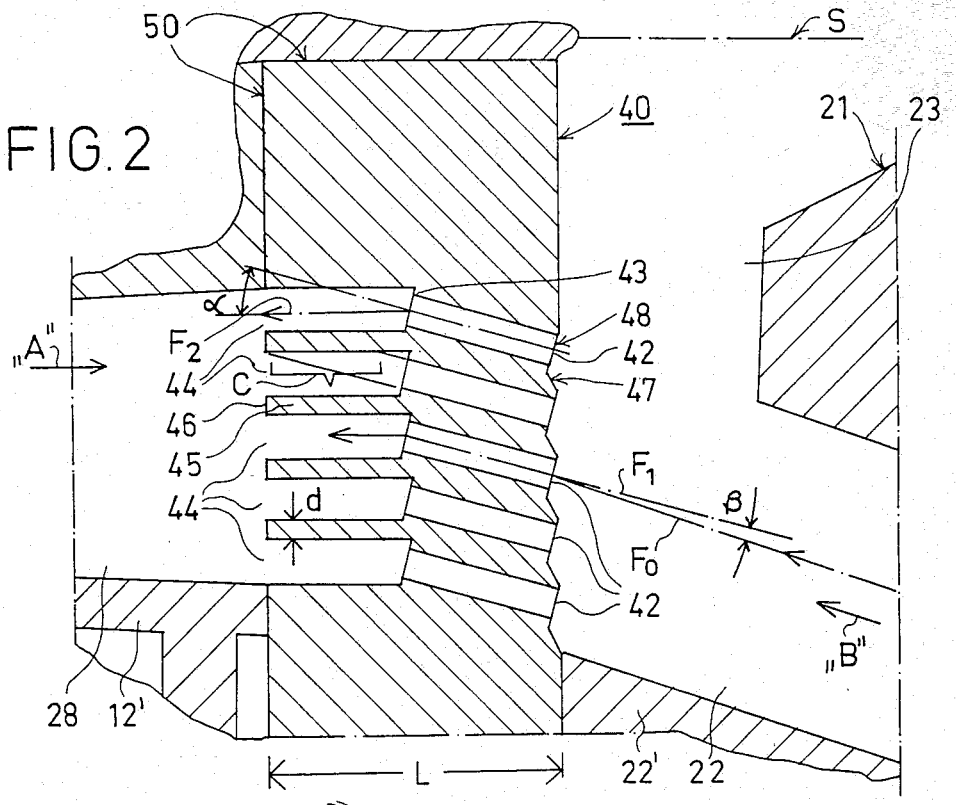
FIG. 2 is a side section view of a turbulence part in a headbox in accordance with the present invention, shown on an enlarged scale.
Figure 7:
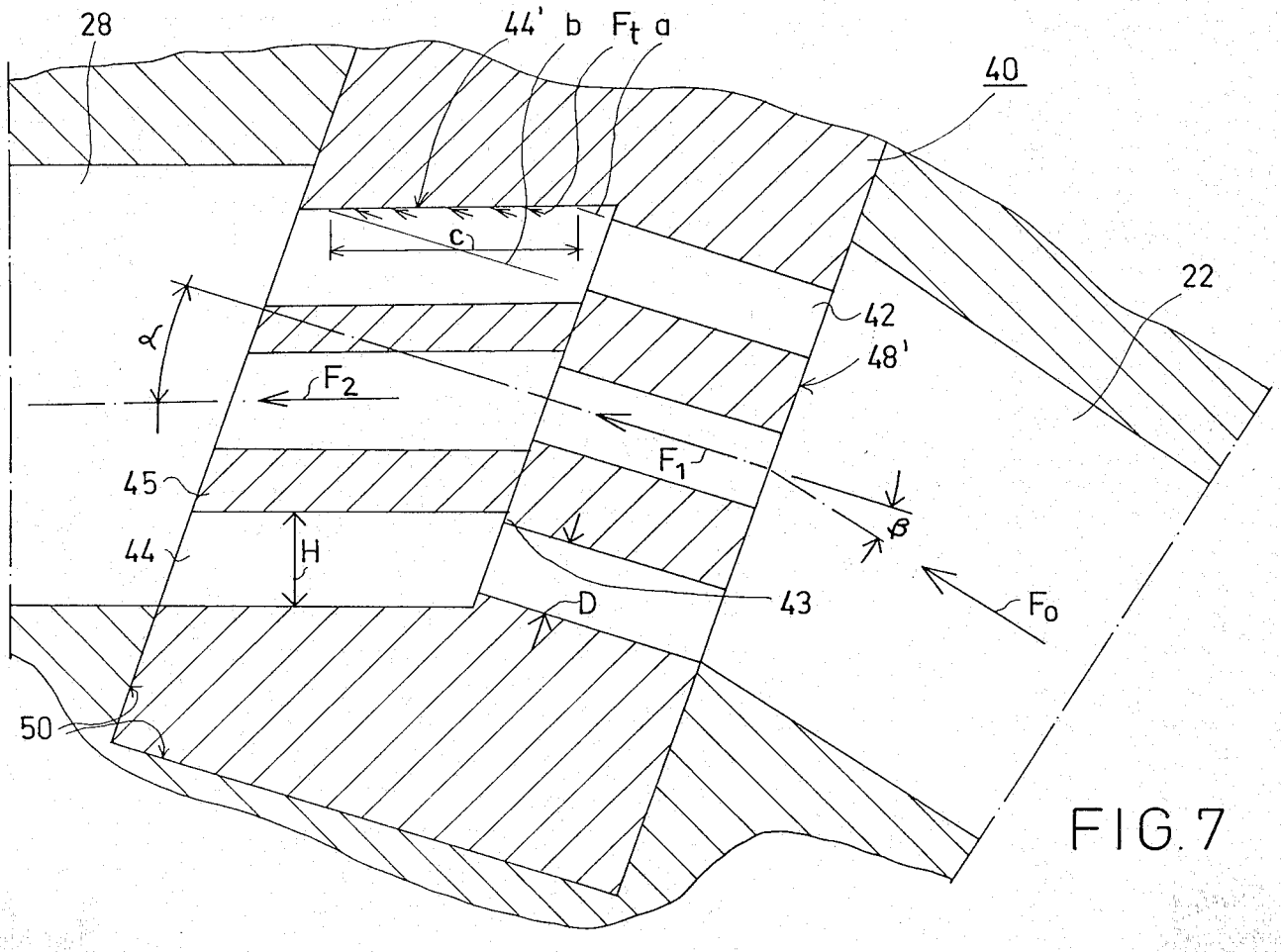
FIG. 7 is a side sectional view on an enlarged scale of a turbulence part of a headbox in accordance with the present invention.

Referring now to FIGS. 2 and 7, the axial direction of the flow bores 42 and the direction of the pulp suspension flowing therethrough form a small declining angle $\beta$ with respect to the flow direction $F_0$ of the pulp suspension which prevails in the equalizing chamber 22. The magnitude of the angle $\beta$ is preferably in the range of about 5° to 15° and, most preferably, about 10°. The objective of this construction is to maintain the inlet side of the flow generator member clean and free of obstructions.

The outlet mouths of the flow bores 42 have diameters D which are smaller than the height H of the flow slots 44. In this manner, the outlet mouths of the flow bores 42 open into the respective flow slots 44 by way of a widening step 43. The diameter of the flow bores is preferably in the range of about 8 to 20 mm while the height H of the flow slots 44 are preferably in the range of about 11 to 30 mm.

The planes of the flow slots 44 as well as the main direction $F_2$ of the pulp suspension flowing therewithin form a small angle $\alpha$ with respect to the axial direction of the flow bores 42. The magnitude of the angle $\alpha$ is generally within the range of about 5° to 45° and, most preferably, within the range of about 10° to 20°. The direction of the plane of the flow slots 44 is substantially the same as the main direction of the flow in the slice cone 28.

The operation of the turbulence generator 40 incorporated in the headbox of the present invention will now be described with respect to FIG. 7. The flow rate of the pulp suspension is accelerated in the flow bores 42 and the tubular jets discharged from the outlet mouths of the flow bores collide against the upper walls 44' of the flow slots 44 theoretically within the zone designated C. The colliding flow is illustrated by arrows $F_t$. In practice, the collision of the pulp suspension flow does not occur within the entire zone C defined by the lines designated a and b which are extensions of the walls of the flow bores but, rather, the jet-like flow is at least in its bottom region curved smoothly so that its principal direction becomes substantially parallel to the plane of the flow slots 44. When the tubular jets are discharged from the holes 42 and meet the upper walls 44' of the slots 44, the flows are disbursed in a lateral direction as well as forwardly, so that in this manner a favorable lateral spreading of the tubular flow into a slot-like flow is obtained. At the same time, the flow rate decreases in the slots 44 relative to the flow rate which prevails in the flow bores 42. In this manner, the pulp suspension is discharged from the flow slots 44 in a controlled manner and in a relatively unperturbed manner into the slice cone 28 where its speed is initially further reduced. If necessary, such as in order to prevent contamination, the outlet edges of the walls 45 defining the flow slots 44 may be provided with a rounded shape.

Referring now to FIG. 2, the front wall of the turbulence generator 40, i.e., the wall which faces the equalizing chamber 22 is formed in a step-wise fashion so that at the inlet mouths of the flow bores 42, the front wall portions extend perpendicularly to the axial direction of the flow bores 42. Substantially planar bevelled front wall portions 47 extend between the perpendicular front wall portions. In this manner, contamination of the inlet mouths of the flow bores 42 is prevented.

According to the embodiment of the invention illustrated in FIG. 7, the front wall 48' of the turbulence generator member 40 is inclined over its entire area with respect to the horizontal plane, the front wall 48 extending substantially perpendicularly to the axial direction of the flow bores 42.

The angles $\alpha$ and $\beta$ are illustrated in FIGS. 2–5 and 7. In practice, the angle $\alpha$ is preferably larger than the angle $\beta$. The angle $\alpha+\beta$ corresponds to the angle of change in direction over which the flow is turned from the upwardly slanting direction which prevails in the equalizing chamber 22 to the direction of flow which is substantially parallel to the wire or wires 14.

Turning now to the embodiment of the invention illustrated in FIG. 8, the headbox illustrated therein has a shorter design than that illustrated in FIG. 1. More particularly, the headbox illustrated in FIG. 8 is similar to that shown in FIG. 1 except that it has neither an equalizing chamber part 22 nor a distributor-pipe part 20 per se. Moreover, the headbox illustrated in FIG. 8 also lacks an air container 24. According to the embodiment of FIG. 8, the headbox comprises a distributor beam 16' which becomes narrower in the flow direction and which is, at its top and bottom, defined by planar walls 52 and 53, respectively. The rear wall of the distributor beam is constituted by an inclined wall 54 which is provided with supporting ribs 55. The front wall of the distributor beam 16' of the headbox is constituted by a plate-like turbulence generator member 40' similar to that described above in connection with the embodiment of FIG. 1 which at the same time functions as the distribution part of the headbox and which is analogous to the distributor pipe system 20. In accordance with the above, the combined turbulence generator member 50 and distribution part 40' comprises the flow passages 42 and 44 situated one after the other as described above in connection with FIG. 1 and which, in accordance with the invention, function as means for changing the flow direction of the pulp suspension as well as means for spreading the flow from a tubular flow to a slack-like flow. All of the constructional details illustrated in the embodiments of FIGS. 2–7 can also be applied in the construction of the headbox illustrated in FIG. 8. It is therefore seen that in accordance with FIG. 8, a headbox is provided whose construction is quite short and compact in the machine direction.

The turbulence generator member in accordance with the invention is also highly advantageous in its manufacture since the flow bores 42 can be drilled and polished at reasonable production costs as can the flow slots 44. By suitably selecting the magnitudes of the angles $\alpha$ and $\beta$ as well as the diameter of the flow bores 42, the number of rows of flow bores and their mutual spacing h, as well as the height H of the flow slots 44 and the length L of the turbulence generator member 40, it is possible to optimize the operation of the the turbulence generator member under all circumstances with regard to the quality of pulp utilized, the quality of the paper to be produced, and in view of the speed of the paper machine. It should be emphasized that the angles $\alpha$ and $\beta$ must not be excessively large since such a situation will denigrate from the objectives of the invention. The invention may also be carried out so that the angle $\beta$ has a zero or even a negative value.

Obviously, numerous modifications and variations of the present invention are possible in the light of the above teachings. It is therefore to be understood that within the scope of the claims appended hereto, the invention may be practiced otherwise than as specifically disclosed herein.

What is claimed is:

1. In a headbox for a paper machine including a distributor beam part communicating with a distribution part, and a turbulence part followed by a slice part, said turbulance part comprising a turbulence generator member provided with a plurality of flow bores, each flow bore having an inlet mouth and an outlet mouth, the improvement comprising:

said plurality of flow bores being elongated and disposed in a plurality of substantially transverse rows, said flow bores each having a substantially circular cross-section;

a plurality of elongated flow slots of substantially rectangular cross-section formed in said turbulence generator member with the outlet mouths of a respective, substantially transverse row of said flow bores opening into a respective flow slot; and wherein a central plane of each flow slot forms an angle with the axes of said flow bores in the respective row, the magnitude of said angle being in the range of about 5° to 45° and angles of all said plurality of slots with said respective rows extending in the same direction with respect to one another.

2. The combination of claim 1 wherein the magnitude of said angle is in the range of about 10° to 20°.

3. The combination of claim 1 wherein said headbox further includes an equalizing chamber situated between said distribution part and said turbulence part in which equalizing chamber a pulp suspension in adapted to flow in an upwardly slanted flow direction, and wherein the axes of said flow bores form a declining angle with the flow direction in said equalizing chamber.

4. The combination of claim 3 wherein said declining angle is in the range of about 5° to 15°.

5. The combination of claim 4 wherein said declining angle is about 10°.

6. The combination of claim 1 wherein said rows of flow bores are arranged in said turbulence generator member as at least two substantially horizontal rows, adjacent flow bores in each row being spaced at a certain horizontal distance from each other, and wherein the outlet mouths of each row of flow bores open into a single respective flow slot at a widening step, and wherein said flow slots have a relatively long transverse dimension.

7. The combination of claim 6 wherein said flow slots extend over substantially the entire transverse width of the headbox.

8. The combination of claim 6 wherein the axes of corresponding flow bores formed in adjoining rows lie in a plane which is inclined with respect to the vertical plane, and wherein the relative horizontal direction phase shift between flow bores in adjoining rows located one over the other is h/n, where h is said horizontal distance by which adjacent flow bores in each row are spaced from each other, and n is the number of flow bore rows and flow slots.

9. The combination of claim 1 wherein the turbulence generator member has a certain longitudinal dimension and wherein the outlet mouths of the flow bores open into said flow slots at a location substantially midway along said longitudinal dimension.

10. The combination of claim 1 wherein said turbulence generator member is substantially plate-shaped and has a substantially planar front wall.

11. The combination of claim 1 wherein said turbulence generator member has a front wall including portions onto which the inlet mouths of the flow bores open, which portions are substantially perpendicular to the direction of the axes of the flow bores.

12. The combination of claim 11 wherein substantially planar bevelled front wall portions extend between said perpendicular front wall portions.

13. The combination of claim 1 wherein the diameter of said flow bores is in the range of about 8 to 20 mm, the height of said flow slots is in the range of about 11 to 20 mm, and the length of said turbulence generator member is in the range of about 60 to 150 mm.

14. The combination of claim 14 wherein said flow slots are defined between a series of transversely extending wall portions, and wherein each wall portion has a length in the range of about 2 to 10 mm.

15. The combination of claim 1 wherein said headbox further includes an equalizing chamber and wherein said turbulence generator member is constituted by a plate-shaped cassette which is interchangeable with other like cassettes, and wherein said headbox includes means for fastening said turbulence generator member between the equalizing chamber and the slice part.

16. The combination of claim 15 wherein said fastening means includes a groove-shaped channel formed in the headbox.

17. The combination of claim 1 wherein said turbulence generator member at the same time functions both as the distribution part as well as the turbulence part so that said turbulence generator member is situated to constitute a front wall of the distributor beam part such that the inlet mouths of the flow bores open into the distributor beam part and wherein the flow slots of the turbulence generator member open into the slice part.

18. The combination of claim 1 wherein the headbox further includes an equalizing part and wherein the turbulence generator member is situated between the equalizing part and the slice part and wherein the equalizing part is preceded in the direction of flow of the pulp suspension by a distributor-pipe part forming a part of the distributor beam part.

19. The combination of claim 1, in which said flow slots and said slice part are disposed to direct flow in a substantially horizontal direction.

20. The combination of claim 1 comprising five rows of flow bores and five respective flow slots.

21. The combination of claim 1, wherein a diameter of each flow bore is substantially constant in an axial direction thereof, and a height of each flow slot is substantially constant in the direction said central plane of each flow slot extends.

22. The combination of claim 6, in whcih each respective flow slot continuously extends in the transverse direction thereof.

23. In a headbox for a paper machine including a distributor beam part communicating with a distribution part, and a turbulence part followed by a slice part, said turbulence part comprising a turbulence generator member provided with a plurality of flow bores, each flow bore having an inlet mouth and an outlet mouth, the improvement comprising:

said plurality of flow bores being elongated and disposed in a plurality of substantially transverse rows, said flow bores each having a substantially circular cross-section;

a plurality of elongated flow slots of substantially rectangular cross-section formed in said turbulence generator member with the outlet mouths of a respective, substantially transverse row of said flow bores opening into a respective flow slot;

wherein a central plane of each flow slot forms an angle with the axes of said flow bores in the respective row, the magnitude of said angle being in the range of about 5° to 45°;

angles of all said plurality of slots with said respective rows extending in the same direction with respect to one another; and wherein said planes of said flow slots are substantially parallel with respect to one another, and said axes of said flow bores are substantially parallel with respect to one another.

24. In a headbox for a paper machine including a distributor beam part communicating with a distribution part, and a turbulence part followed by a slice part, said turbulence part comprising a turbulence generator member provided with a plurality of flow bores, each flow bore having an inlet mouth and an outlet mouth, the improvement comprising:

said plurality of flow bores being elongated and disposed in a plurality of substantially transverse rows, said flow bores each having a substantially circular cross-section;

a plurality of elongated flow slots of substantially rectangular cross-section formed in said turbulence generator member with the outlet mouths of a respective, substantially transverse row of said flow bores opening into a respective flow slot;

wherein a central plane of each flow slot forms an angle with the axes of sid flow bores in the respective row, the magnitude of said angle being in the range of about 5° to 45°;

angles of all said plurality of slots with said respective rows extending in the same direction with respect to one another; and wherein diameters of the outlet mouths of said flow bores are smaller than the height of each respective slot into which the outlet mouths of said flow bores open, so that each row of flow bores opens into a single respective flow slot at a widening step.

* * * * *